US007204224B2

(12) United States Patent
Hazelton et al.

(10) Patent No.: US 7,204,224 B2
(45) Date of Patent: Apr. 17, 2007

(54) ENGINE BLOCK STRUCTURE

(75) Inventors: Gary J. Hazelton, White Lake, MI (US); Franz Decarli, Garden City, MI (US); Scott M. Kociba, Clarkston, MI (US); Christopher W. Zwolensky, Grand Blanc, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/375,428

(22) Filed: Mar. 14, 2006

(65) Prior Publication Data

US 2007/0056548 A1 Mar. 15, 2007

Related U.S. Application Data

(60) Provisional application No. 60/716,462, filed on Sep. 13, 2005.

(51) Int. Cl.
*F02F 7/00* (2006.01)
*F01M 5/00* (2006.01)
*F01M 1/00* (2006.01)

(52) U.S. Cl. ..... 123/195 C; 123/196 R; 123/196 A; 123/196 AB

(58) Field of Classification Search ..... 123/195 R, 123/195 C, 196 R, 196 A, 196 AB; 184/104.2, 184/106

See application file for complete search history.

(56) References Cited

U.S. PATENT DOCUMENTS

| | | | | | |
|---|---|---|---|---|---|
| 2,093,570 | A * | 9/1937 | Meyer | 184/6.3 |
| 3,707,202 | A * | 12/1972 | Dixon | 123/196 A |
| 5,136,993 | A * | 8/1992 | Ampferer et al. | 123/195 C |
| 5,452,692 | A * | 9/1995 | Spray et al. | 123/195 C |
| 5,647,315 | A * | 7/1997 | Saito | 123/196 AB |
| 6,705,270 | B1 * | 3/2004 | Rau et al. | 123/195 C |
| 6,941,922 | B2 * | 9/2005 | Williams et al. | 123/196 R |

* cited by examiner

*Primary Examiner*—Noah P. Kamen
(74) *Attorney, Agent, or Firm*—John E. Kajander

(57) ABSTRACT

An internal combustion engine includes a crankcase and an upper oil pan. The crankcase includes a plurality of main bearing caps extending between a pair of side walls, with openings in the main bearing caps and in the side walls. The upper oil pan is configured to sealingly engage the crankcase, and includes openings therethrough, which align with the openings in the main bearing caps and the side walls when the upper oil pan engages the crankcase. Fasteners structurally tie the upper oil pan to both the crankcase side walls and the main bearing caps. The engine may further include a lower oil pan defining a sump and attached to the upper oil pan. The upper oil pan preferably includes an oil filter manifold, an oil scraper, and a plurality of oil passages, while also providing a windage tray.

13 Claims, 3 Drawing Sheets

ENGINE BLOCK STRUCTURE

CROSS-REFERENCE TO RELATED APPLICATIONS

This application claims priority to U.S. Provisional Patent Application No. 60/716,462 filed on Sep. 13, 2005.

TECHNICAL FIELD

This invention relates to internal combustion engines and more particularly to an arrangement of an engine and an associated oil pan for reducing engine noise.

BACKGROUND OF THE INVENTION

It has been suggested in the art relating to internal combustion engines, including diesel engines, that the sound or noise generated by engine operation may be reduced by various means, such as stiffening portions of the engine structure, enclosing portions of the engine with sound absorbing or intercepting shields or covers and/or attaching various exterior components of the engine structure, such as cylinder head covers and oil pans, by sound isolating mounting means. Some proposed arrangements involve penalties in added cost and reduced serviceability of the engine or its installation as well as, in some cases, making assembly of the engine more difficult.

Internal combustion engines may use lubricating oil for many purposes including for example, lubricating moving parts, actuating cam phasers, and controlling switching valve lifters for valve stepping and cylinder deactivation. Typically an oil pan is disposed beneath a cylinder block and crankshaft of an internal combustion engine, and configured to receive oil that drains or is otherwise exhausted from the cylinder block, crankshaft and/or main bearings that support the crankshaft. The oil collects in a sump of the oil pan, and is then pumped from a sump pick-up location into a lubrication system associated with the engine.

SUMMARY OF THE INVENTION

The present invention provides an internal combustion engine including at least a crankcase and an upper oil pan. The crankcase includes a plurality of main bearing caps extending between a pair of side walls, with a first set of openings in the main bearing caps and a second set of openings in the side walls. The upper oil pan is configured to sealingly engage a corresponding surface of the crankcase, and includes third and fourth sets of openings therethrough. When the upper oil pan engages the crankcase, the first set of openings align with the third set of openings, and the second set of openings align with the fourth set of openings. A first set of fasteners are extendable through the first and third sets of openings, while a second set of fasteners are extendable through the second and fourth sets of openings. The first and second sets of fasteners, when engaged, integrate the upper oil pan with both the crankcase side walls and the main bearing caps to reduce vibration and noise radiation from the engine.

The internal combustion engine may also include a lower oil pan defining a sump, with the upper oil pan attached to the lower oil pan. The upper oil pan can include an oil filter manifold and/or an oil scraper, and is preferably configured to further provide a windage tray. The upper oil pan may further include a plurality of oil passages to facilitate proper functioning of the internal combustion engine.

The above features and advantages and other features and advantages of the present invention are readily apparent from the following detailed description of the best modes for carrying out the invention when taken in connection with the accompanying drawings.

DESCRIPTION OF PREFERRED EMBODIMENTS

Figure 1:
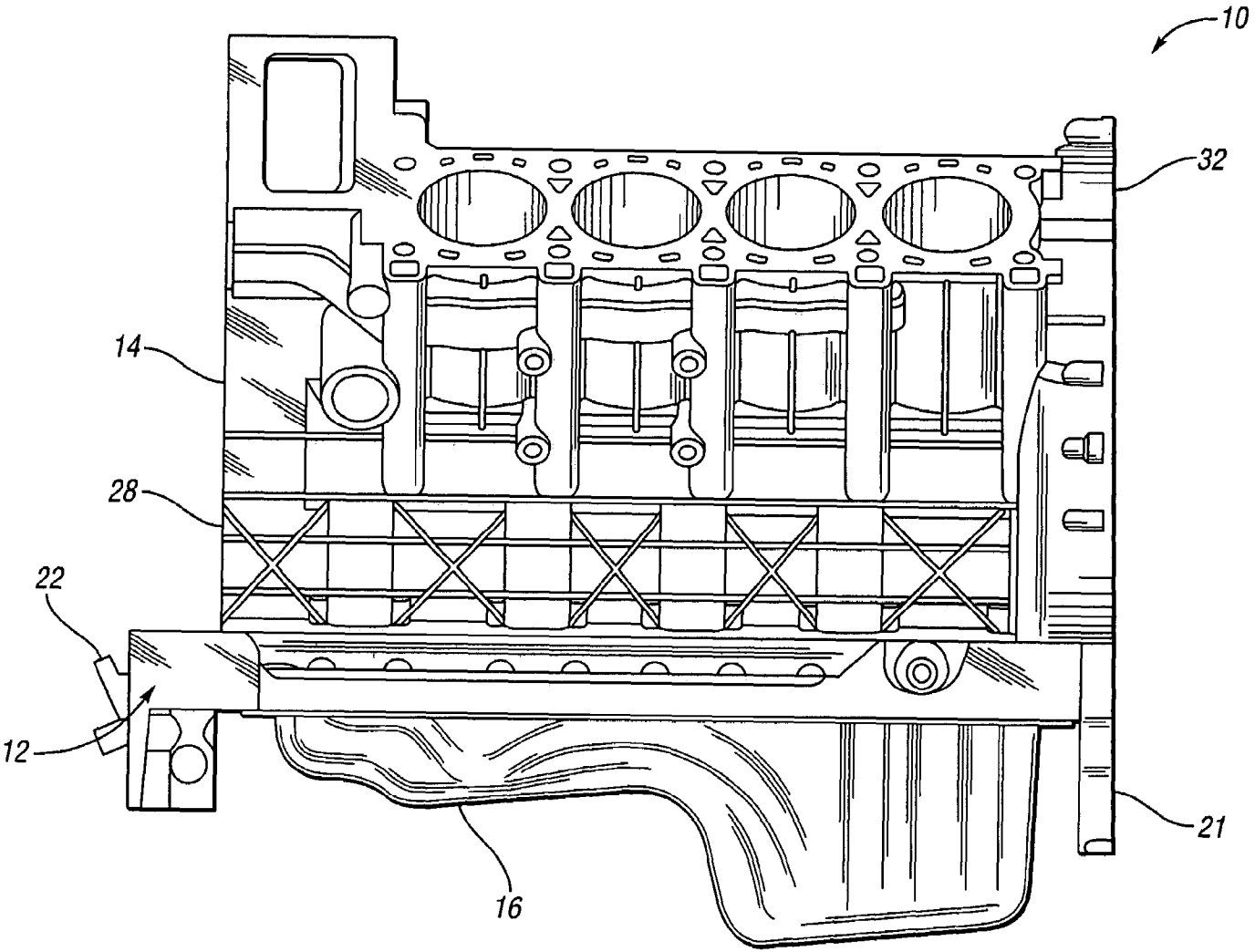
FIG. 1 shows an internal combustion engine according to the present invention.

Referring to the drawings, wherein like reference numbers refer to like components, FIG. 1 shows an internal combustion engine generally indicated at 10 including an upper oil pan 12 attached to a crankcase 14, with a lower oil pan 16 attached to a bottom of upper oil pan 12. The lower oil pan 16 defines a reservoir for the collection of oil used to lubricate the internal engine components during operation thereof. Preferably, the oil pans 12, 16 are constructed of cast material, such as an alloyed aluminum, or other suitable, lightweight material.

Figure 2:
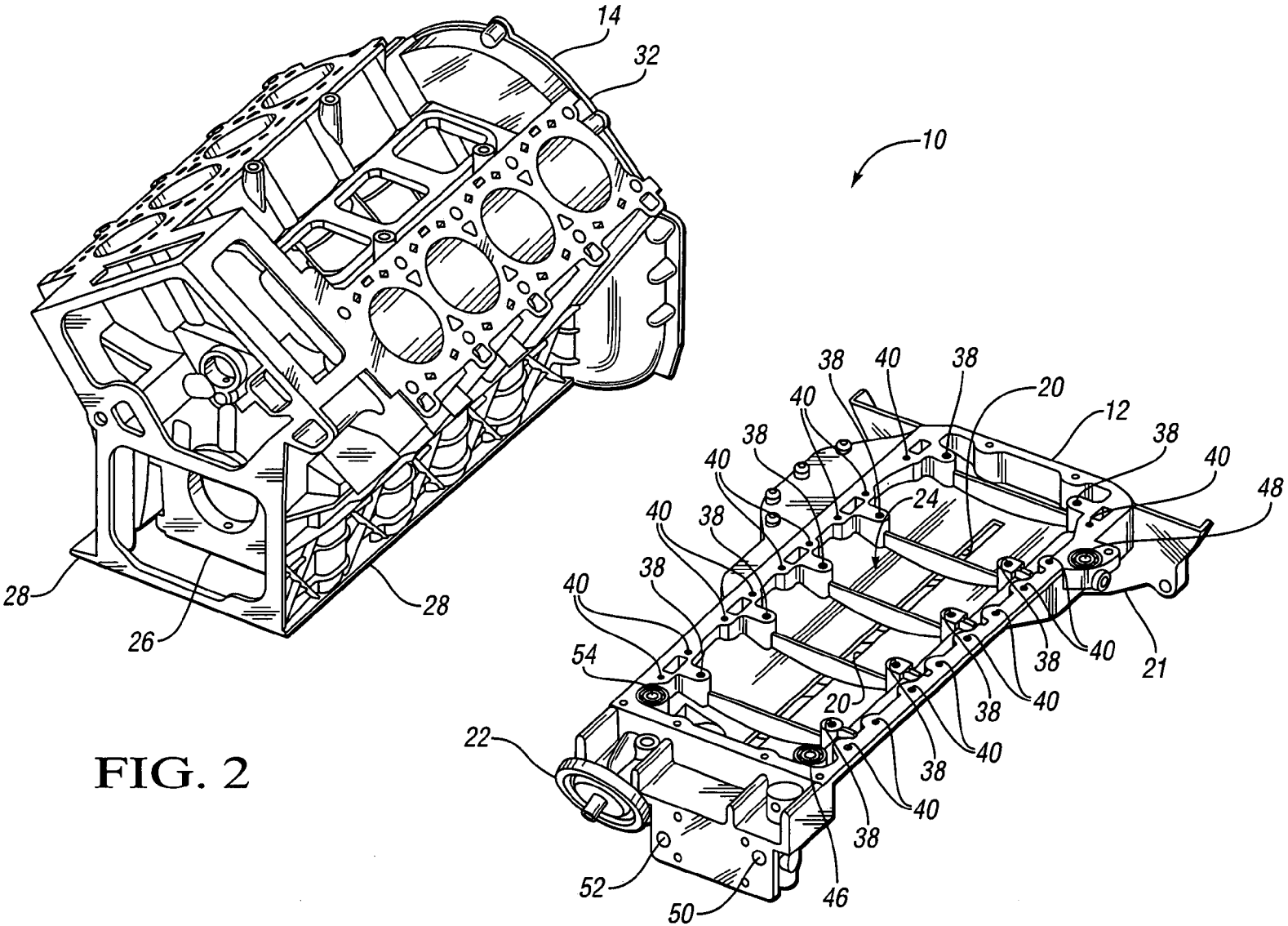
FIG. 2 shows a perspective view of the engine of FIG. 1 with an upper oil pan removed from a crankcase.
Figure 3:
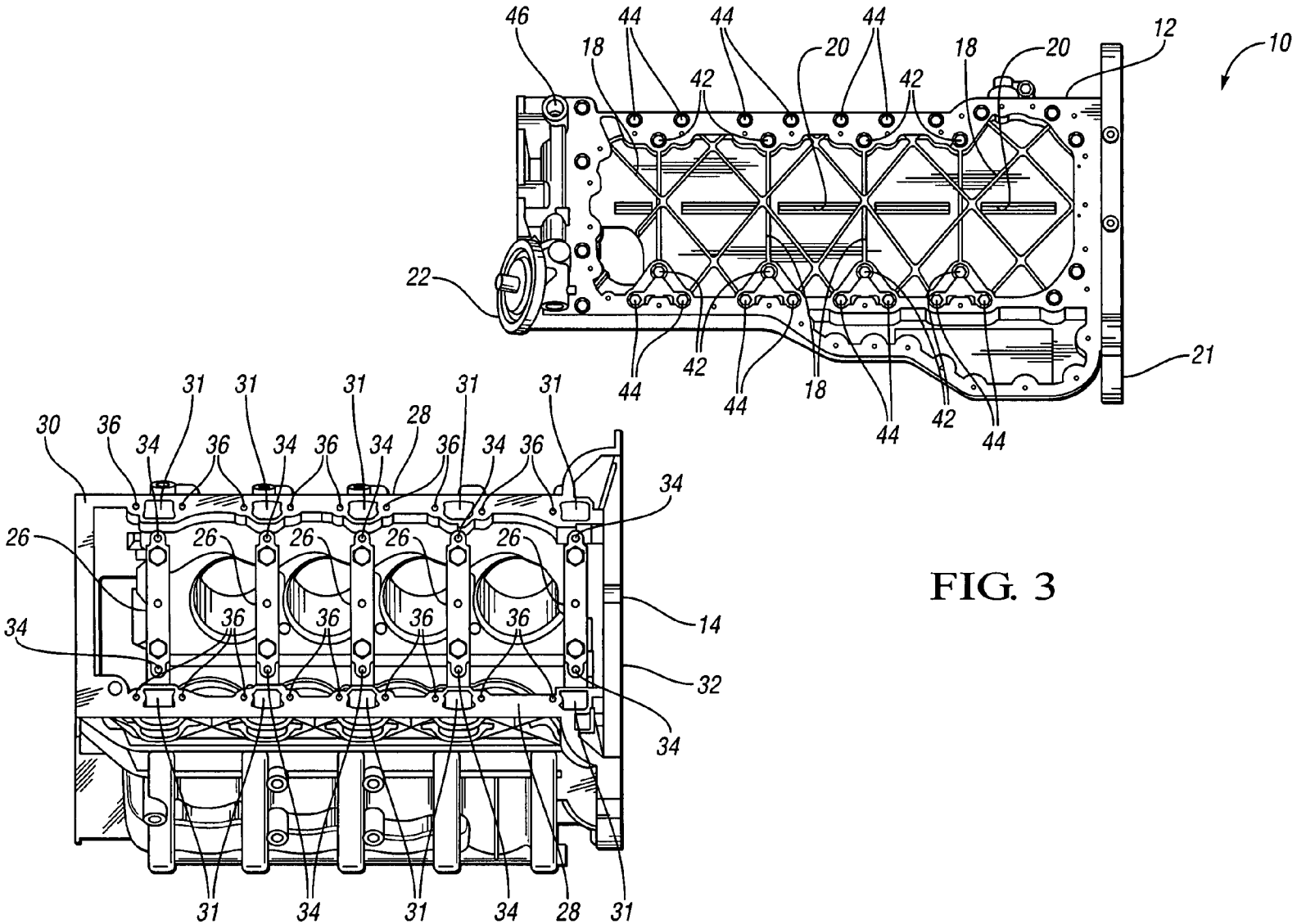
FIG. 3 shows an underside of the engine of FIG. 1 with the upper oil pan removed from the crankcase.

FIGS. 2 and 3 shows the engine 10 with the upper oil pan 12 removed from the crankcase 14. FIG. 2 shows a top of the upper oil pan 12 in greater detail, while FIG. 3 shows the engine 10 from an underside thereof to better illustrate the inventive concept, with the bottom of the upper oil pan 12 shown in detail.

The upper oil pan 12 preferably includes webs 18 which provide strength and rigidity thereto. The webs 18 allow the upper oil pan 12 to resist dimensional changes due to forces imparted upon it by the engine 10 while also allowing the use of thinner walls, thereby reducing overall weight. It should be recognized that the configuration of the upper oil pan 12 and the associated webs 18 is merely illustrative; specific configurations of the webs 18 may vary. The upper oil pan 12 includes oil drainback slots 20, and a transmission mounting flange 21 for attachment to a vehicle transmission. Additionally, the upper oil pan 12 includes an oil filter manifold 22 and an oil scraper 24, and further acts as a windage tray as known in the art. By integrating these parts, the upper oil pan 12 reduces the overall number of parts required for proper functioning of the engine 10.

The crankcase 14 includes a plurality of main bearing caps 26 disposed between side walls 28. A sealing flange 30 may be disposed between the crankcase 14 and the upper oil pan 12 to ensure a fluid tight seal therebetween. A plurality of oil drainback openings 31 extend through the side walls 28 to allow oil to drain from cylinder heads as known in the art. The crankcase 14 further includes a transmission mounting flange 32 for attachment to the vehicle transmission.

As shown in FIG. 3, the main bearing caps 26 include a first set of preferably threaded openings 34, while the crankcase side walls 28 include a second set of preferably threaded openings 36. Additionally, the upper oil pan 12 includes third and fourth sets of openings 38, 40. As shown in the drawings, the openings 34, 36, 38, 40 are provided such that the first and second sets of openings 34, 36 create a substantially triangular arrangement, while the third and fourth sets of openings 38, 40 similarly create a substantially triangular arrangement. However, any configuration may be used within the scope of the present invention. The upper oil pan 12 fits to the crankcase 14 such that openings 34 align with openings 38, while openings 36 align with openings 40.

A first set of preferably threaded fasteners 42 extend through the first set of openings 34 within the main bearing caps 26 and through the third set of openings 38 through the upper oil pan 12. Similarly, a second set of preferably threaded fasteners 44 extend through the second set of openings 36 within the side walls 28 of the crankcase 14 and through the fourth set of openings 40 through the upper oil pan 12. The first and second set of fasteners 42, 44 thus integrate the crankcase 14, the upper oil pan 12, and the main bearing caps 26 into a unitary structure. That is, the upper oil pan 12 is effectively a structural member of the crankcase 14, joining the main bearing caps 26 to one another while also attaching to the crankcase side walls 28. The unitary structure reduces distortions imparted to the main bearing caps 26 by the crankshaft 14, thereby limiting vibration and noise radiation from the engine 10 without increasing engine weight. Particularly, by attaching the upper oil pan 12 to both the crankcase side walls 28 and the main bearing caps 26, bearing loads are distributed amongst the side walls 28 and the main bearing caps 26.

It should be noted that in the preferred embodiment of the present invention as shown in the drawings, the second set of fasteners 44 extend through a bottom of the side walls 28 instead of through a side of the side walls 28. Arranging the second set of openings 36 in this manner eases attachment of various other vehicle components to the crankcase 14. For example, typical engine-mounted components such as an air conditioning compressor or a power steering pump can be mounted to the side of side walls 28 without necessitating avoidance of the second set of fasteners 44. Thus, by routing the second set of fasteners 44 through the bottom of the side walls 28, the present invention provides superior strength and rigidity while minimizing loss of attachment space around the crankcase 14.

Referring back to FIG. 2, the upper oil pan 12 is preferably configured to include a plurality of oil passages. In particular, an oil pump (not shown) pumps oil through an oil inlet 46 into the upper oil pan 12. Approximately 10% of the oil entering through the oil inlet 46 exits through a cleaner outlet 48, and proceeds to an oil cleaner (not shown). The other 90% of the oil entering through the oil inlet 46 exits through a cooler outlet 50 to an oil cooler (not shown), and re-enters the upper oil pan 12 through a cooler inlet 52. Additional oil also enters the engine 10 through the oil filter manifold 22 after passing through an oil filter (not shown), and proceeds to the crankcase 14 through an engine outlet 54. It can thus be seen that the upper oil pan 12 according to the present invention provides a plurality of oil passages to facilitate proper functioning of the engine 10.

While the best mode for carrying out the invention has been described in detail, it is to be understood that the terminology used is intended to be in the nature of words and description rather than of limitation. Those familiar with the art to which this invention relates will recognize that many modifications of the present invention are possible in light of the above teachings. It is, therefore, to be understood that within the scope of the appended claims, the invention may be practiced in a substantially equivalent way other than as specifically described herein.

The invention claimed is:

1. An internal combustion engine comprising:

a crankcase including a plurality of main bearing caps extending between a pair of side walls; and an upper oil pan configured to sealingly engage a corresponding surface of said crankcase;

wherein said upper oil pan attaches to said crankcase at said main bearing caps and said side walls, thereby integrating said upper oil pan and said crankcase into a unitary structure.

2. The internal combustion engine of claim 1, wherein said main bearing caps define a first set of openings, said pair of side walls define a second set of openings, and said upper oil pan defines third and fourth sets of openings, and wherein said upper oil pan sealingly engages said crankcase such that said first set of openings align with said third set of openings and said second set of openings align with said fourth set of openings.

3. The internal combustion engine of claim 2, further including a first set of fasteners extending through said first and third sets of openings, and a second set of fasteners extending through said second and fourth set of openings, said first and second sets of fasteners thereby integrating said upper oil pan and said crankcase into a unitary structure.

4. The internal combustion engine of claim 1, further including a lower oil pan defining a sump, said lower oil pan configured to attach to said upper oil pan.

5. The internal combustion engine of claim 1, wherein said upper oil pan includes defines an oil filter manifold configured to direct oil from said internal combustion engine to an oil filter.

6. The internal combustion engine of claim 1, wherein said upper oil pan includes an oil scraping member.

7. The internal combustion engine of claim 1, wherein said upper oil pan is configured to provide a windage tray.

8. The internal combustion engine of claim 1, wherein said upper oil pan defines a plurality of passages to facilitate proper functioning of said internal combustion engine.

9. The internal combustion engine of claim 8, wherein said plurality of oil passages are configured to divert a first portion of oil entering said internal combustion engine to an oil cleaner, and a second portion of oil entering said internal combustion engine to an oil cooler.

10. An internal combustion engine comprising:

a crankcase including a plurality of main bearing caps extending between a pair of side walls;

a lower oil pan defining a sump; and an upper oil pan attached to said lower oil pan and configured to sealingly engage said crankcase, said upper oil pan including at least one of an oil filter manifold and an oil scraper;

wherein said upper oil pan attaches to said crankcase at said main bearing caps and said side walls, thereby integrating said upper oil pan and said crankcase into a unitary structure.

11. The internal combustion engine of claim 10, wherein said upper oil pan is configured to provide a windage tray for said internal combustion engine.

12. The internal combustion engine of claim 10, wherein said upper oil pan includes a plurality of oil passages to facilitate proper functioning of said internal combustion engine.

13. An internal combustion engine comprising:

a crankcase including a plurality of main bearing caps extending between a pair of side walls, said main bearing caps including a first set of openings therein, and said pair of side walls including a second set of openings therein;

an upper oil pan configured to sealingly engage a corresponding surface of said crankcase, said upper oil pan including third and fourth sets of openings therethrough, wherein said first set of openings align with said third set of openings and said second set of openings align with said fourth set of openings when said upper oil pan engages said crankcase; and a first set of fasteners extending through said first and third sets of openings and a second set of fasteners extending through said second and fourth sets of openings to structurally integrate said upper oil pan with said side walls and said main bearing caps, thereby reducing vibration and noise radiation from said internal combustion engine.

* * * * *